US007946426B2

(12) United States Patent
Ohsawa et al.

(10) Patent No.: US 7,946,426 B2
(45) Date of Patent: May 24, 2011

(54) PACKAGE MATERIAL

(75) Inventors: Toshihiro Ohsawa, Kanagawa (JP); Toshiyuki Suto, Kanagawa (JP); Shigeyasu Enomoto, Kanagawa (JP); Akira Mikayama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/857,155

(22) Filed: Aug. 16, 2010

(65) Prior Publication Data

US 2011/0056867 A1 Mar. 10, 2011

(30) Foreign Application Priority Data

Sep. 4, 2009 (JP) ..... 2009-204786

(51) Int. Cl.
*B65D 85/30* (2006.01)

(52) U.S. Cl. ..... 206/586

(58) Field of Classification Search ..... 206/586, 206/521

See application file for complete search history.

(56) References Cited

U.S. PATENT DOCUMENTS

| | | | | | |
|---|---|---|---|---|---|
| 3,356,209 | A | * | 12/1967 | Pezely, Jr | 206/523 |
| 3,701,465 | A | * | 10/1972 | Richter | 206/521 |
| 4,287,265 | A | * | 9/1981 | McKnight | 267/140.3 |
| 5,692,618 | A | * | 12/1997 | Beak | 206/586 |

FOREIGN PATENT DOCUMENTS

| | | |
|---|---|---|
| JP | U-48-102073 | 11/1973 |
| JP | U-54-002575 | 6/1977 |
| JP | U-55-061571 | 10/1978 |
| JP | U-54-116178 | 8/1979 |
| JP | U-54-116179 | 8/1979 |
| JP | U-59-172173 | 11/1984 |
| JP | U-60-136918 | 9/1985 |
| JP | A-05-178372 | 7/1993 |
| JP | A-07-033168 | 2/1995 |
| JP | A-2000-289777 | 10/2000 |
| JP | A-2001-097365 | 4/2001 |
| JP | A-2004-268979 | 9/2004 |

OTHER PUBLICATIONS

Office Action issued in JP Application No. 2009-204786 on May 18, 2010 (with English translation).

* cited by examiner

*Primary Examiner* — Mickey Yu
*Assistant Examiner* — Jenine M Pagan
(74) *Attorney, Agent, or Firm* — Oliff & Berridge, PLC

(57) ABSTRACT

A package material includes cushioning materials and a covering member. The cushioning materials are assigned for three sides of an article to be packaged. Each of the cushioning materials has three projections each projecting outwardly toward three inner walls of the package box and coming into contact with the three inner walls of the package box. The covering member covers at least a portion of the article to be packaged, and supports the cushioning materials assigned for the three different sides of the article to be packaged. The covering member includes plural sets of three openings in which the three projections of the respective cushioning materials are inserted in a state where the cushioning materials are supported; and folded portions that are interposed between the three openings.

5 Claims, 11 Drawing Sheets

PACKAGE MATERIAL

CROSS-REFERENCE TO RELATED APPLICATIONS

This application is based on and claims priority under 35 USC 119 from Japanese Patent Application No. 2009-204786 filed on Sep. 4, 2009.

BACKGROUND

Technical Field

The present invention relates to a package material.

SUMMARY

According to an aspect of the invention, a package material includes cushioning materials and a covering member. The cushioning materials are assigned for three sides of an article to be packaged, which are stretched in different directions. The cushioning materials are interposed between the three sides of the article to be packaged and three inner walls of a package box when the cushioning materials are accommodated in the package box together with the article to be packaged. Each of the cushioning materials has three projections each projecting outwardly toward the three inner walls of the package box and coming into contact with the three inner walls of the package box. The covering member covers at least a portion of the article to be packaged, and supports the cushioning materials assigned for the three different sides of the article to be packaged. The covering member includes plural sets of three openings in which the three projections of the respective cushioning materials are inserted in a state where the cushioning materials are supported; and folded portions that are interposed between the three openings.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments of the present invention will be described.

Figure 1:
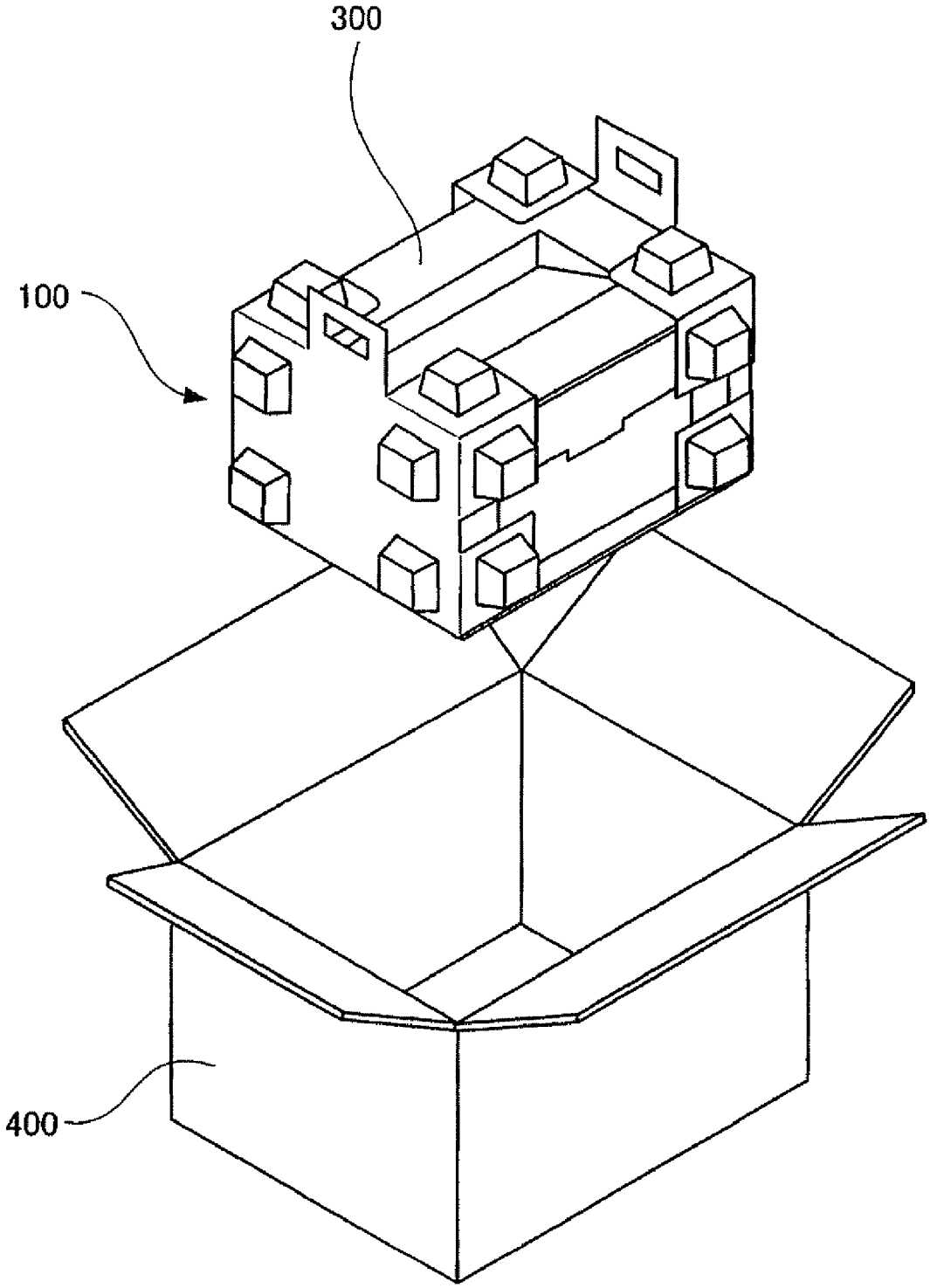
FIG. 1 is a perspective view showing a package material according to a first exemplary embodiment of the present invention.

FIG. 1 is a perspective view showing a package material according to a first exemplary embodiment of the present invention.

A package material 100 shown in FIG. 1 is to package an article 300 to be packaged, for example, an electronic equipment article. The package material 100 is accommodated in a package box 400 along with the article 300 where the article 300 is packaged. With the package material 100 accommodated in the package box 400, the package material 100 secures the article 300 in the package box 400 and protects the article 300 against shocks from the outside of the package box 400. As one example of the article 300, a printer is shown in FIG. 1. This exemplary embodiment will be illustrated with a printer 300 as the article 300.

Figure 2:
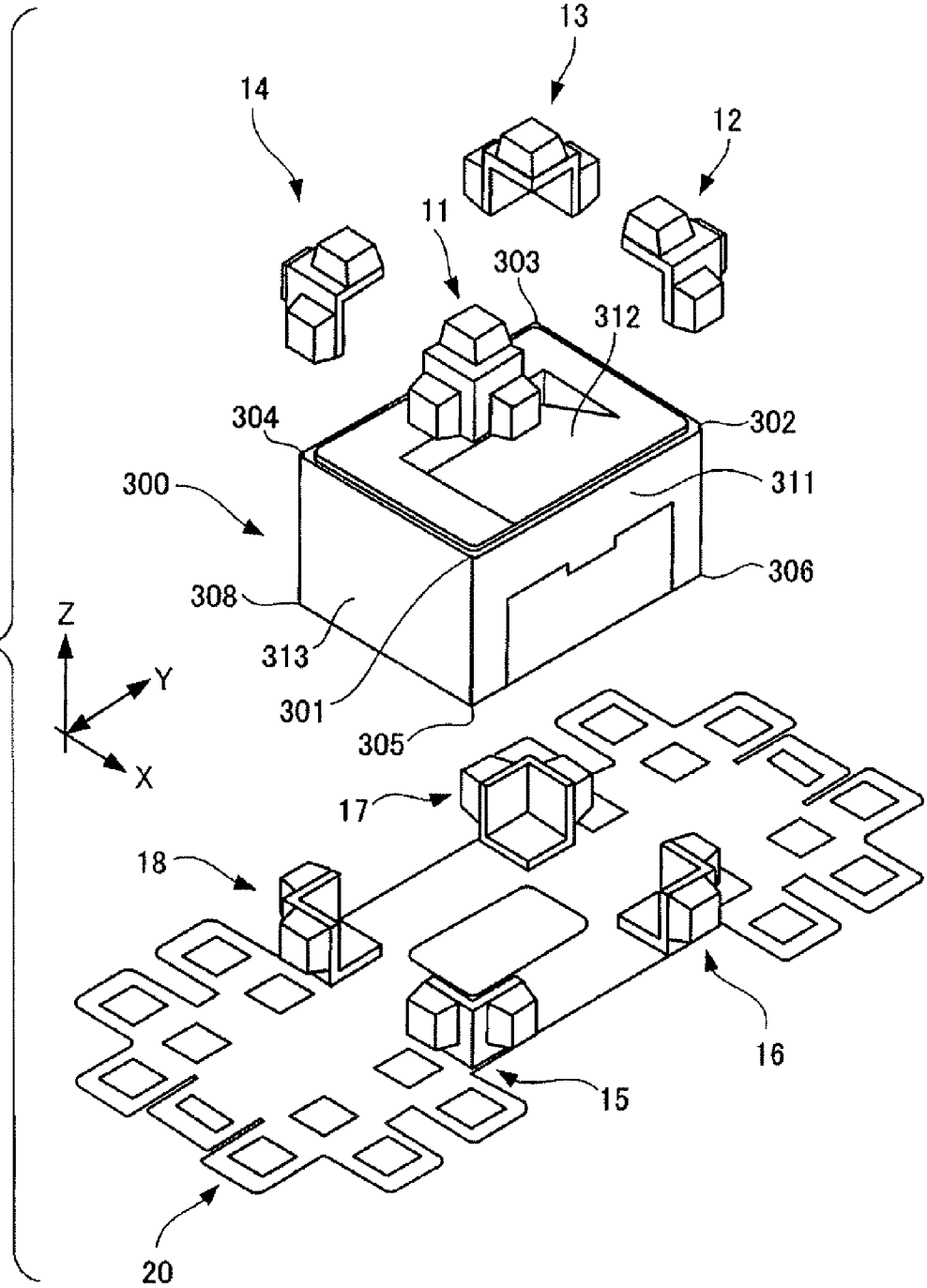
FIG. 2 is a perspective view showing a state of the package material shown in FIG. 1 during assembly.

FIG. 2 is a perspective view showing a state of the package material shown in FIG. 1 during assembly.

The printer 300, as an article to be packaged, shown in FIG. 2 has a bottom side, a top side and four lateral sides contacting the bottom and top sides and further has 8 corners 301, 302, 303, 304, 305, 306 and 308 at which three of the six sides intersects with each other. In addition, FIG. 2 shows three sides 311, 312 and 313 of the six sides of the printer 300, which constitute a front side on which an operational panel (not shown) operated by a user is arranged, a top side and a left side, respectively.

The package material 100 includes 8 cushioning materials 11, 12, 13, 14, 15, 16, 17 and 18 and an auxiliary sheet 20. The cushioning materials 11 to 18 are assigned for the corners 301 to 308 of the printer 300, respectively, and are interposed between the corners 301 to 308 of the printer 300 and inner walls of the package box 400 (see FIG. 1) with them accommodated in the package box 400. Although FIG. 2 shows the auxiliary sheet 20 before it is folded, the auxiliary sheet 20 covers the bottom side and two of the lateral sides of the printer 300 by being folded as shown in FIG. 1 and is stretched across the eight cushioning materials 11 to 18. Here, the auxiliary sheet 20 corresponds to an example of a covering member mentioned in the present invention.

Figure 3A:
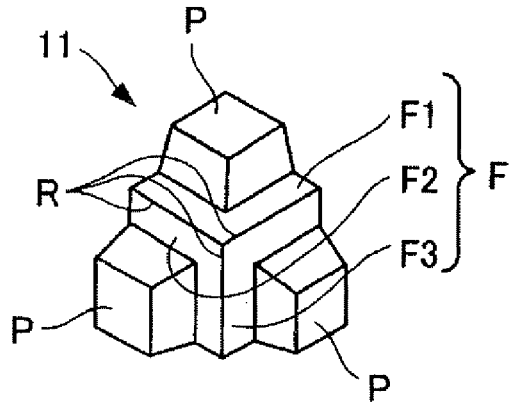
FIGS. 3A to 3C are perspective views showing a cushioning material shown in FIG. 2.
Figure 3B:
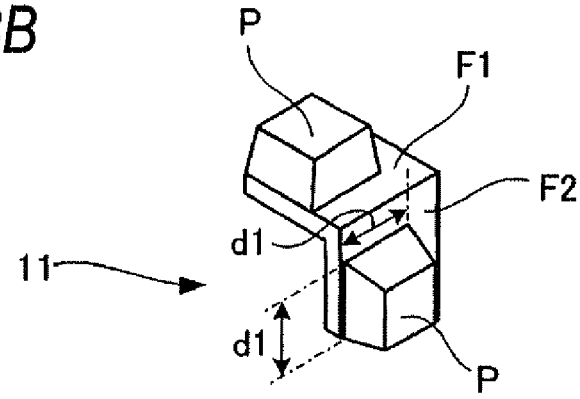
Figure 3C:
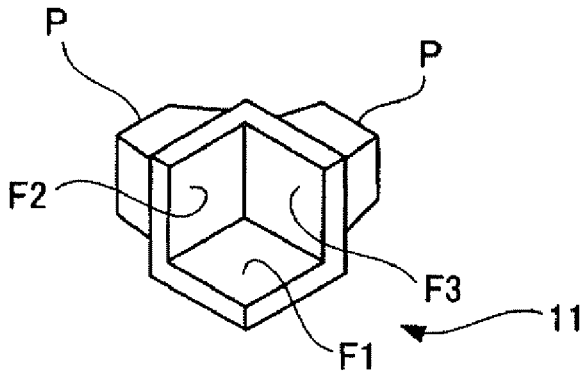

FIGS. 3A to 3C are perspective views showing the cushioning material shown in FIG. 2. FIGS. 3A to 3C are perspective views of the cushioning materials 11 when viewed from 3 different angles. However, the eight cushioning materials 11 to 18 (see FIG. 2) shown in FIG. 2 have the same structure.

The cushioning material 11 includes a flat board part F constituted by three flat boards F1, F2 and F3 on three sides, and 3 projections P projecting from the three respective flat boards F1, F2 and F3 on the three sides constituting the flat board part. The three flat boards F1, F2 and F3 are interconnected to be substantially perpendicular to each of the corners 301 to 308 (see FIG. 2) of the printer 300 in such a manner that they comes into contact with three respective planes constituting the corners 301 to 308. The flat boards F1, F2 and F3 are interconnected with ridges R formed therebetween. The three projections P project outwardly from the respective flat boards F1, F2 and F3, with the cushioning material 11 assigned to the corners 301 to 308 of the printer 300, when viewed from the printer 300. Each projection P has a tapered shape. More specifically, each projection P has a truncated pyramidal shape. The cushioning material 11 is made of material, for example, foam polystyrene, which is softer than the printer 300. The flat board part F and the three projections P are integrally molded.

Figure 4:
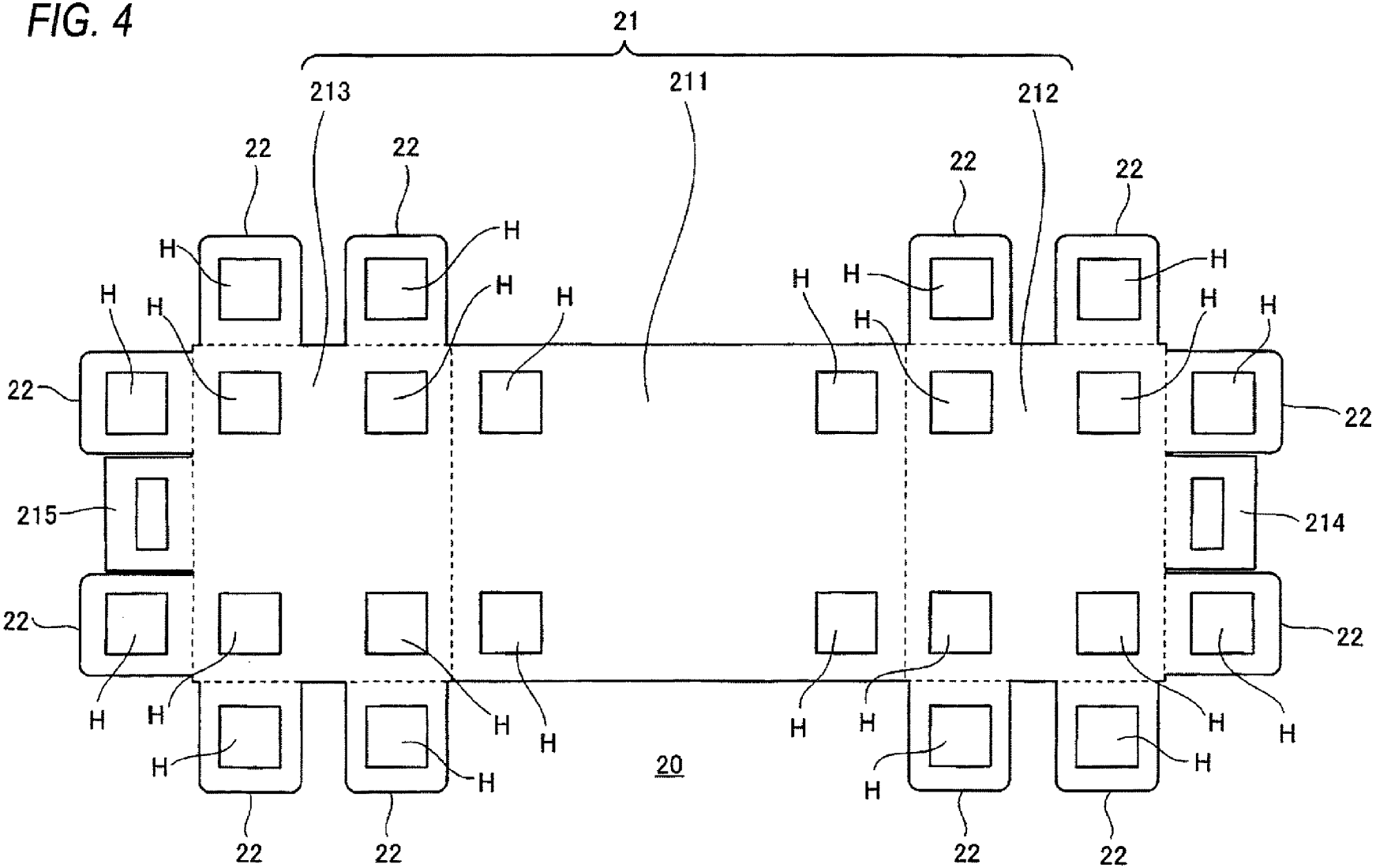
FIG. 4 is a view showing an auxiliary sheet shown in FIG. 2.

FIG. 4 is a view showing the auxiliary sheet shown in FIG. 2. The condition before the auxiliary sheet 20 is folded is shown in FIG. 4.

The auxiliary sheet 20 is formed by a board, for example, a corrugated cardboard, and includes a substantially rectangular body plate 21, and 12 fold pieces 22 connected to and stretched across edges of the body plate 21. The body plate 21 includes a bottom plate portion 211 facing the bottom side of the printer 300 and lateral side plate portions 212 and 213 stretched from both sides of the bottom plate portion 211. Handles 214 and 215 are provided at edges of the two respective lateral side plate portions 212 and 213, which are away from the bottom plate portion 211. In addition, the fold pieces 22 and the body plate 21 have respective openings H in which the projections P (see FIGS. 3A to 3C) of the cushioning materials 11 to 18 are inserted.

Figure 5:
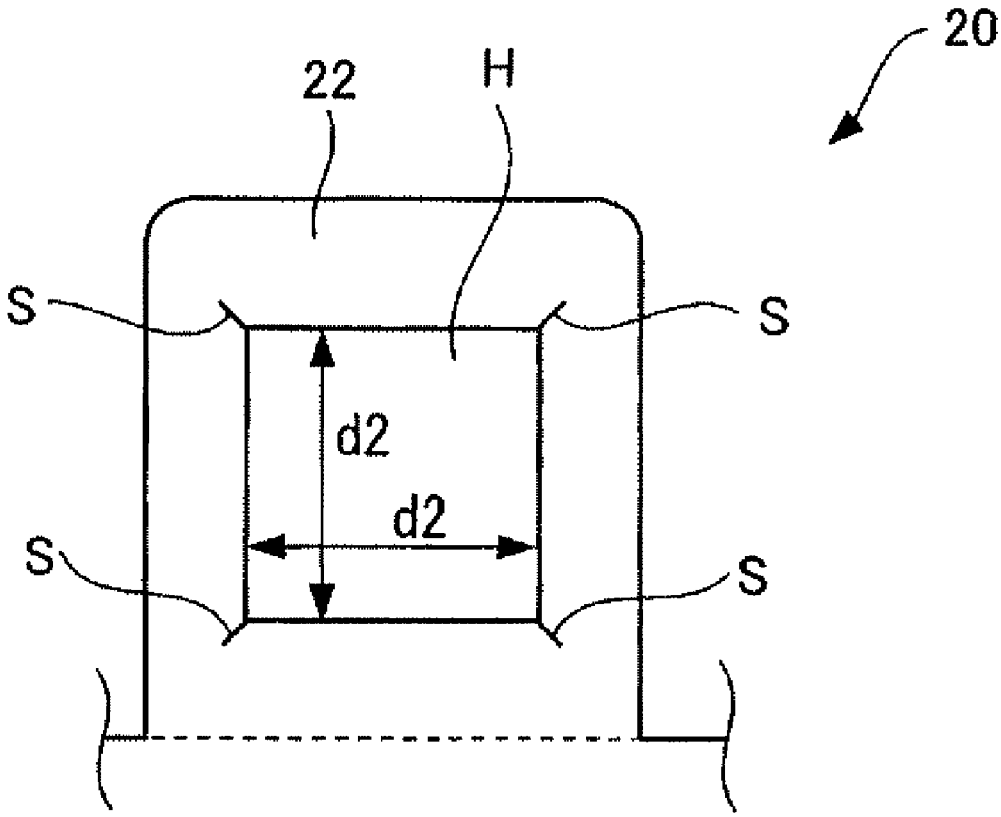
FIG. 5 is an enlarged view showing a fold piece of the auxiliary sheet shown in FIG. 4.

FIG. 5 is an enlarged view showing a fold piece of the auxiliary sheet shown in FIG. 4.

The openings H formed in the body plate 21 and the fold pieces 22 have a dimension smaller than that of the base of the projections P to be inserted in the openings H. In this exemplary embodiment, each opening H is of a square form and its length and width dimension is d2. The dimension d2 is smaller than the length and width dimension d1 of the base of the projection P of the cushioning materials 11 shown in FIG. 3B. In addition, cuts S associated with the openings H are formed in the auxiliary sheet 20. More specifically, as shown in FIG. 5, four cuts S are each formed in four corners of a square opening H.

In actuality, the auxiliary sheet 20 shown in FIG. 4 is completed by being folded at a substantially right angle by dashed lines shown in FIG. 4 when the package material 100 is assembled. Here, portions folded along the dashed lines shown in FIG. 4 correspond to an example of folded portions of the present invention.

Now, assembling of the package material 100, i.e., packaging of the printer 300, will be described.

When the package material 100 is assembled, four cushioning materials 15 to 18 are placed on the bottom plate portion 211 of the auxiliary sheet 20, as shown in FIG. 2. At this point, the projections P of the four cushioning materials 15 to 18 are inserted in the openings H (FIG. 4) provided in the bottom plate portion 211 (see FIG. 4). As described above, since the openings H formed in the auxiliary sheet 20 has the dimension smaller than that of the base of the projections P and the cuts S associated with the openings H are formed in the auxiliary sheet 20, edges of the openings H are pushed away when the bases of the projections P are fully inserted in the openings H, thereby preventing the projections P from falling out. That is, the cushioning materials 15 to 18 are surely fixed to the auxiliary sheet 20 without using an adhesive. Such sure fixation may be likewise achieved for other projections P and openings H which will be described later.

Next, the printer 300 is placed on the cushioning materials 15 to 18 and the four cushioning materials 15 to 18 are assigned to the four corners 305 to 308 of the bottom side of the printer 300. Then, the remaining four cushioning materials 11 to 14 are assigned to the four corners 301 to 304 of the top side of the printer 300. At this time, the eight cushioning materials 11 to 18 are assigned in a positioning where the flat plates F1, F2 and F3 on the three sides of each cushioning material 11 to 18 come into contact with the three respective planes constituting each of the corners 301 to 308 of the printer 300.

Figure 6:
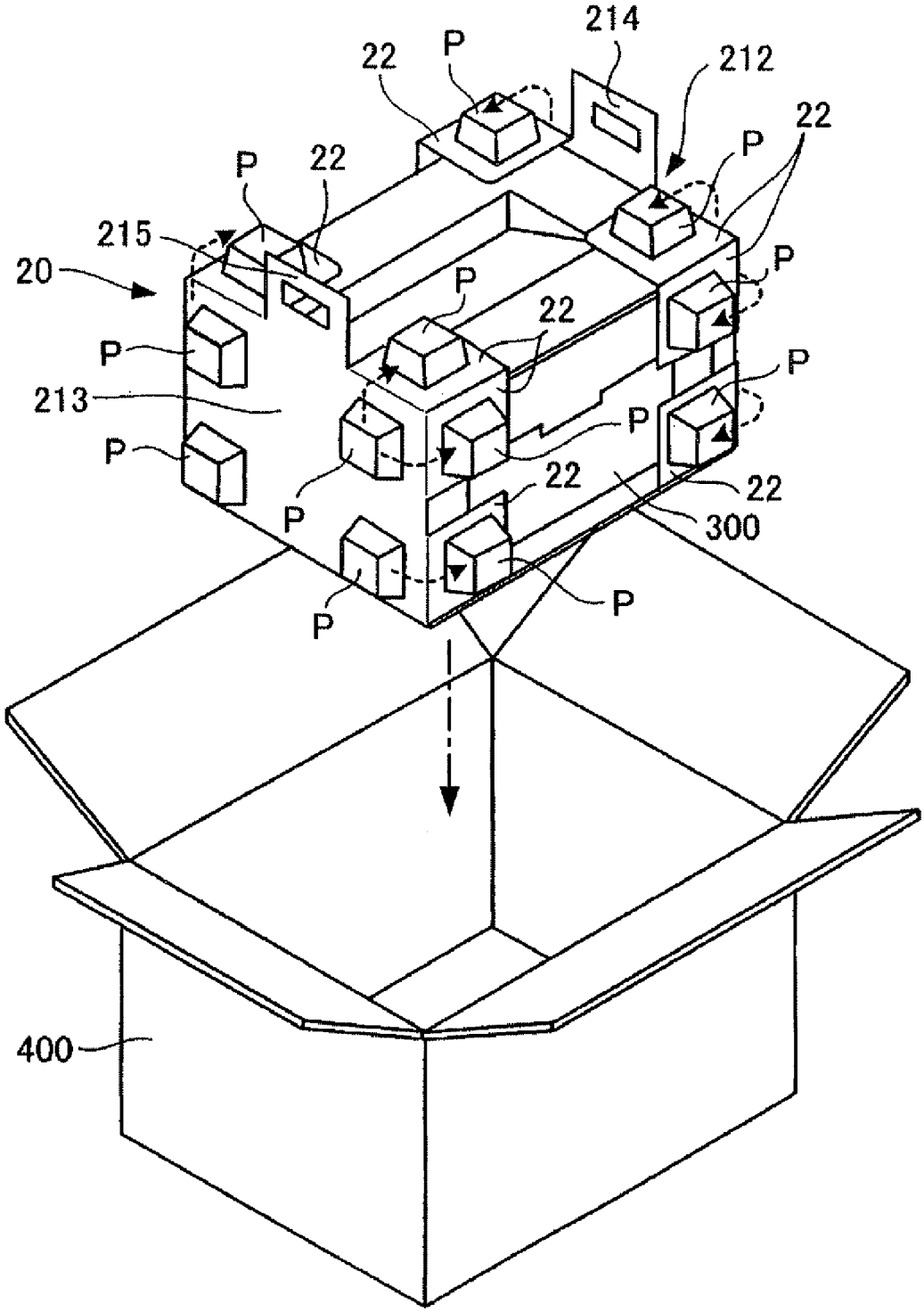
FIG. 6 is a perspective view for explaining a method of assembling a package material.

FIG. 6 is a perspective view for explaining a method of assembling the package material.

Next, as shown in FIG. 6, the auxiliary sheet 20 is folded along the dashed lines shown in FIG. 4. For such folding, first, the lateral side plate portions 212 and 213 of the auxiliary sheet 20, which are stretched to both sides of the bottom plate portions 211 (see FIG. 4), are folded, and the projections P arranged in the lateral sides of the printer 300 are inserted in the openings H provided in the lateral side plate portions 212 and 213. Such folding allows the lateral side plate portions 212 and 213 to conform to both sides of the printer 300. Next, the four fold pieces 22 stretched from the lateral side plate portions 212 are folded and the projections P are inserted in the openings H provided in the fold pieces 22. This folding allows the fold pieces 22 to conform to sides except both lateral sides, the top side and the bottom side of the printer 300, that is, the front side and the rear side of the printer 300.

Figure 7:
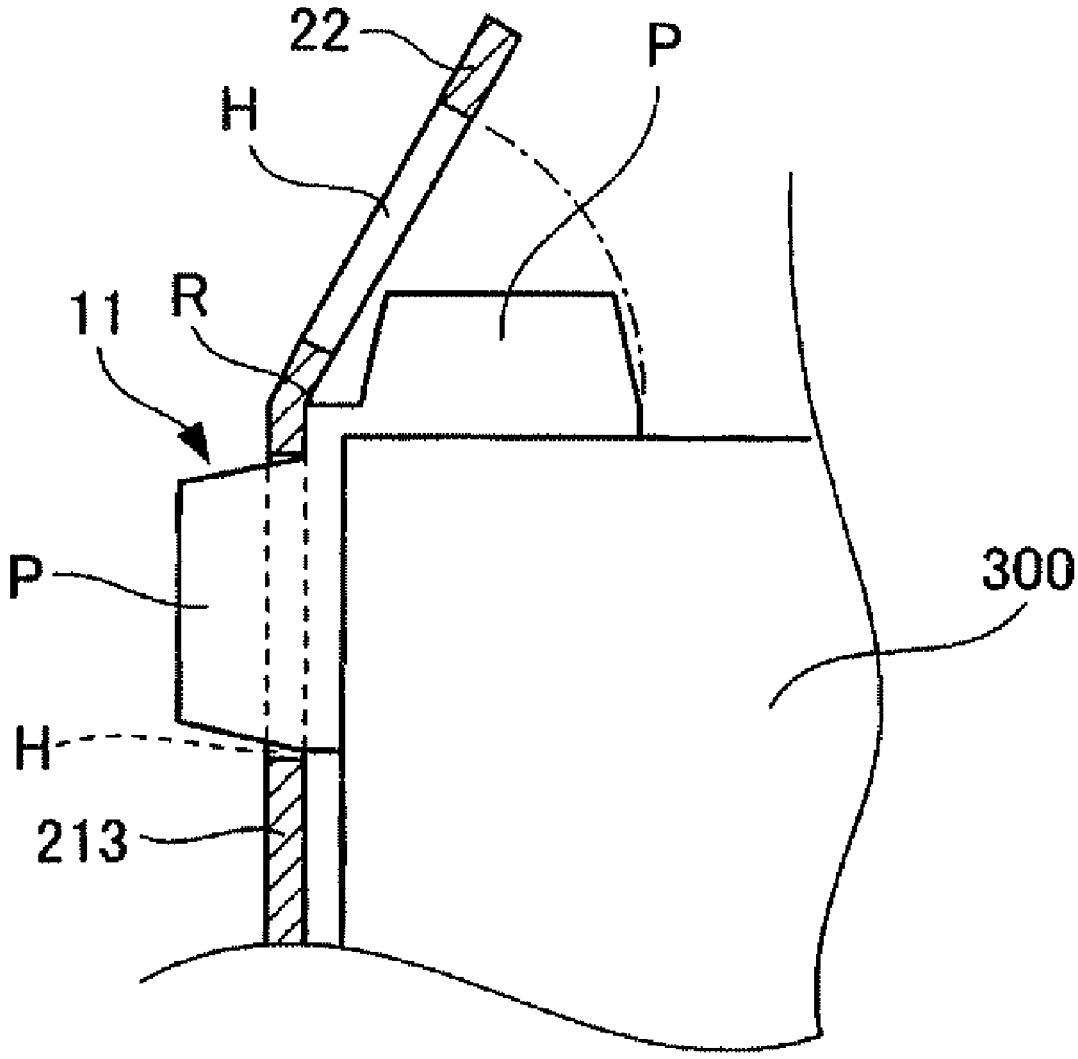
FIG. 7 is a sectional view for explaining a state where a projection is inserted in an opening along with folding of the auxiliary sheet.

Next, the four fold pieces 22 arranged on the top side of the lateral side plate portion 213 of the auxiliary sheet 20 are folded and the projections P arranged on the top side of the printer 300 are inserted in the openings H provided in the fold pieces 22. FIG. 7 is a sectional view for explaining a state where a projection is inserted in an opening along with folding of the auxiliary sheet. FIG. 7 shows a state where four fold pieces 22 arranged on the top side of the lateral side plate portion 213 of the auxiliary sheet 20 is being folded toward the top side 312 of the printer 300.

In the state shown in FIG. 7, one of three projections P of the cushioning material 11 is placed in an opening H provided in the lateral side plate portion 213. A fold piece 22 is rotated around the ridge R of the cushioning material 11 when the fold piece 22 is folded. Here, since the projection P has a tapered shape, the fold piece 22 is folded up to a position at which the base of the projection P is fully inserted in the opening H, without any interference of an edge of the fold piece 22 with a head of the projection P.

As shown in FIG. 6, when all fold pieces 22 are folded, folded portions are formed between the openings H (see FIG. 4). In addition, with all fold pieces 22 folded, the four cushioning materials 15 to 18 assigned for the bottom side of the printer 300 are supported by the bottom plate portion 211 (see FIG. 4), the lateral side plate portions 212 and 213 and the fold pieces 22 folded in the lateral sides of the auxiliary sheet 20. In addition, the four cushioning materials 11 to 14 assigned for the top side of the printer 300 are supported by the lateral side plate portions 212 and 213 and the fold pieces 22 folded in the lateral sides and the top side of the auxiliary sheet 20.

Next, the package material 100 having all fold pieces 22 folded is accommodated in the package box 400 along with the printer 300. When a cover of the package box 400 is closed after the package material 100 is accommodated in the package box 400, all projections P of the eight cushioning materials 11 come into contact with the inner walls of the package box. When the package material 100 is accommodated in the package box 400, an operator or a working machine moves the package material 100 by means of the handles 214 and 215. The handles 214 and 215 are folded to the top side of the printer 300 before the cover of the package box 400 is closed after the package material 100 is put in the package box 400.

Under a state where the package material 100 packages the printer 300 and is accommodated in the package box 400, the package material 100 protects the printer 300 against external shocks from the outside of the package box 400, which may be caused by, for example, dropping of the package box 400 itself, etc. In this case, as a force may be concentrated on the cushioning materials 11 to 18, the cushioning material 11 itself may be broken into many pieces. In particular, if a force from each plane is concentrated on the ridge R of the cushioning material 11 shown in FIG. 3A, the cushioning material 11 may be broken at a portion of the ridge R. However, for the package material 100 of this exemplary embodiment, each of the projections P is fixed to each of the cushioning materials 11 to 18 by means of the auxiliary sheet 20, and accordingly, even if the cushioning materials 11 to 18 are broken, the broken portions will not be dislocated from its original positions. Accordingly, the cushioning materials 11 to 18 maintain their own shape assigned for the corners 301 to 308 of the printer 300, thereby preventing capability to protect the printer 300 from being damaged.

In addition, the auxiliary sheet 20 keeps its own positioning by means of the cushioning materials 11 to 18. This prevents the auxiliary sheet 20 from coming into contact with the package box 400 and the printer 300 even in the state where the package material 100 and the printer 300 are accommodated in the package box 400. Accordingly, the auxiliary sheet 20 is less deformed as compared to when it comes into contact with the package box and the printer.

Figure 8:
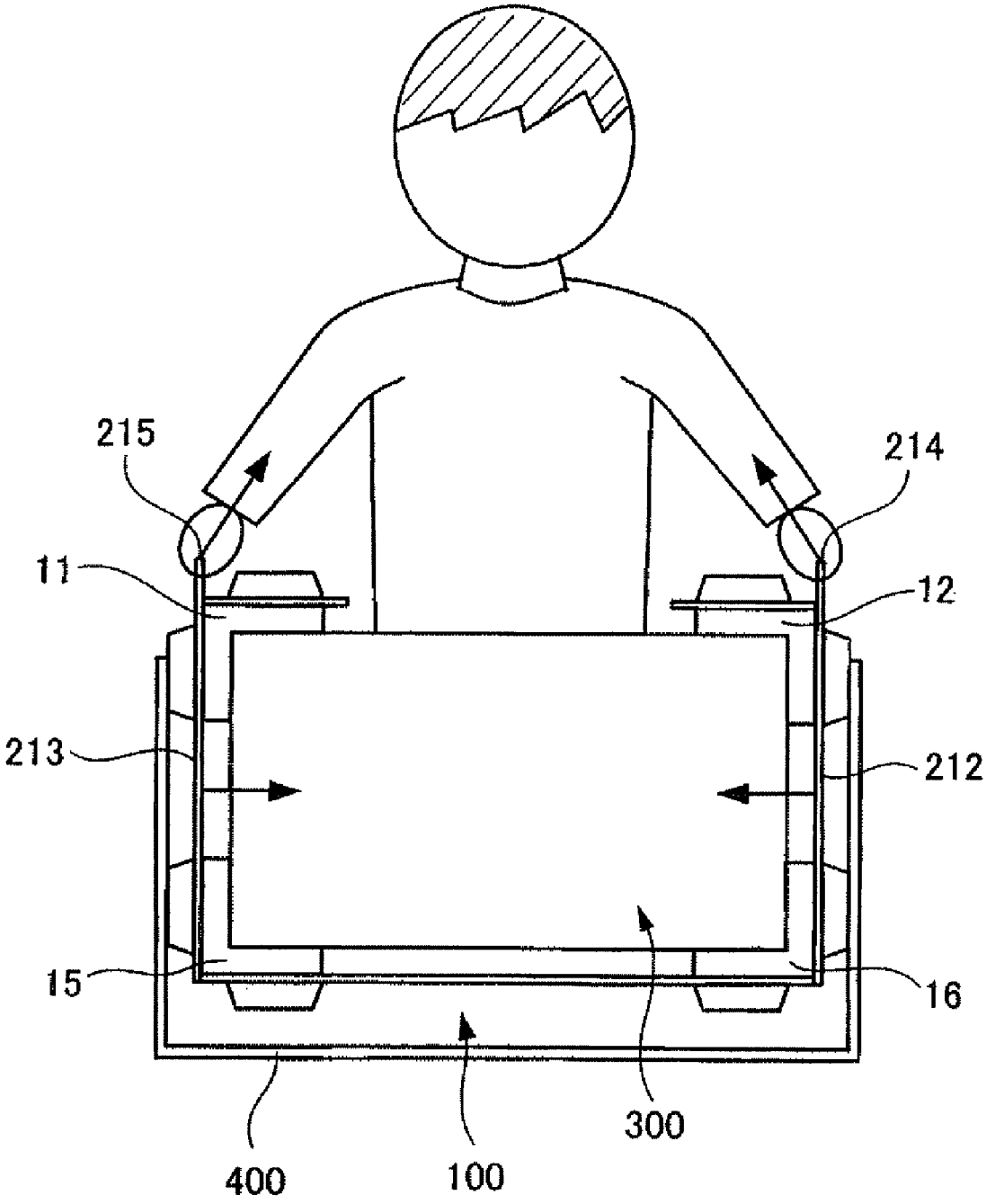
FIG. 8 is a schematic sectional view for explaining taking a printer out of a package box according to the present exemplary embodiment.

FIG. 8 is a schematic sectional view for explaining taking the printer out of the package box according to the present exemplary embodiment.

In order to take the printer 300 out of the package box 400, an operator or a user uncovers the package box 400, holds the handles 214 and 215 with both hands, and lifts up the printer 300 together with the package material 100. At this time, in addition to an upward force, an attracting force is exerted on both lateral side plate portions 212 and 213 of the package material 100. That is, a force in a direction in which the cushioning materials 11 to 18 are pressed toward the inner side away from the inner walls of the package box 400, i.e., toward the printer 300 side, is exerted on the cushioning materials 11 to 18. Accordingly, when the printer 300 is taken out, the printer 300 is more strongly fixed by means of the cushioning materials 11 to 18 and friction between the cushioning materials 11 to 18 and the inner walls of the package box 400 is reduced. Accordingly, taking of the printer 300 in/out of the package box is reliably and easily achieved. In addition, the auxiliary sheet 20 is supported by the cushioning materials 11 to 18 and contact of the auxiliary sheet 20 with the package box 400 can be avoided when the printer 300 is taken out of the package box 400.

In addition, when the operator or the user places the package material 100 packaging the printer 300 on a floor or a stand and holds and moves the handles 214 and 215 so as to be apart from each other, both lateral side plate portions 212 and 213 are bent halfway and the four upper cushioning materials 11 to 14 are drawn and spread in both of the left and right sides. That is, the entire printer 300 appears at once. Accordingly, the printer 300 can be simply taken out of the package material 100.

Although it has been illustrated in the above-described first exemplary embodiment that the eight independent cushioning materials are assigned for the eight respective corners of the printer 300, some of the cushioning materials may be integrated together. Hereinafter, second and third exemplary embodiments in which some of the cushioning materials are integrated together will be described.

Figure 9:
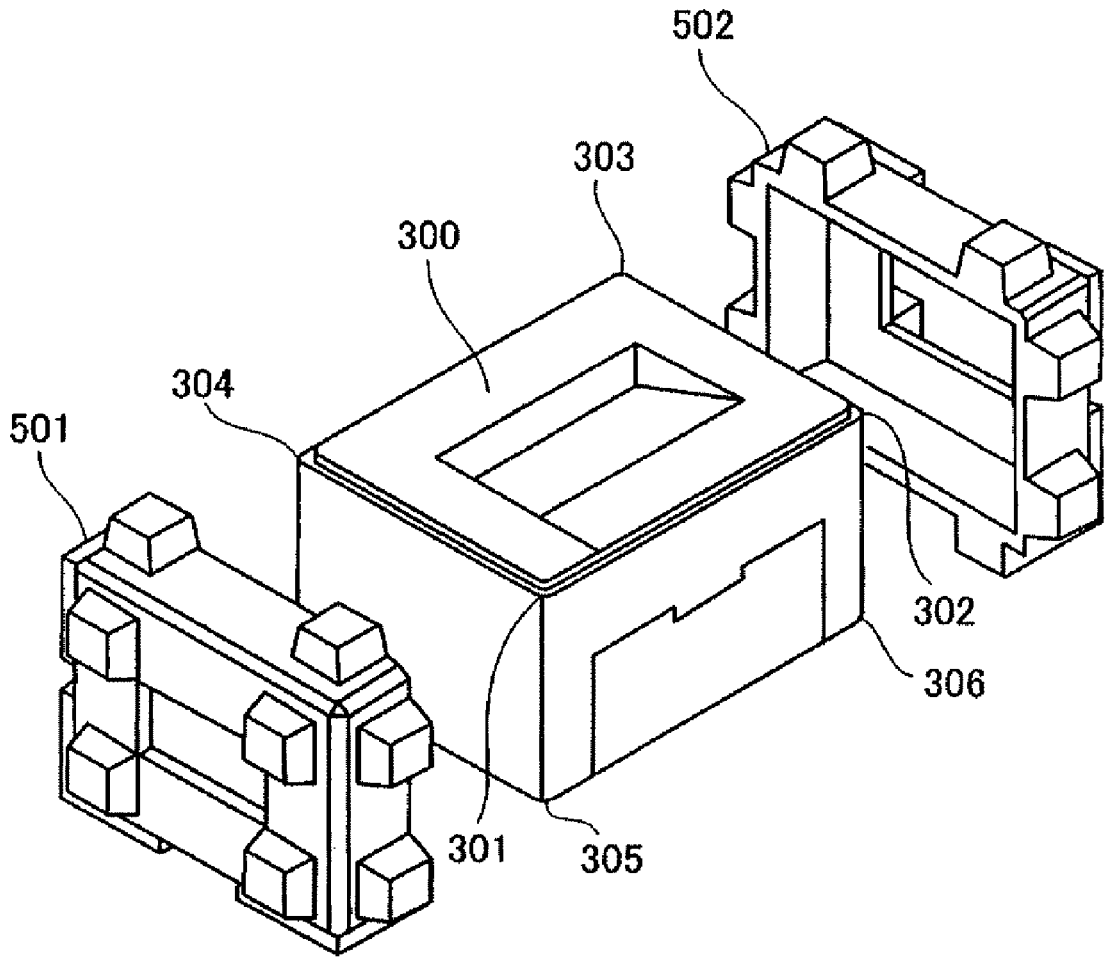
FIG. 9 is a perspective view showing a cushioning material according to a second exemplary embodiment of the present invention.

FIG. 9 is a perspective view showing cushioning materials according to a second exemplary embodiment of the present invention.

A package material of the second exemplary embodiment is different in shape of the cushioning materials from but has the same auxiliary sheet 20 (see FIG. 2) as that of the first exemplary embodiment, which is therefore not shown in FIG. 9.

Two cushioning materials 501 and 502 shown in FIG. 9 correspond to an integrated portion 501 corresponding to the four left corners and an integrated portion 502 corresponding to the four right corners, respectively, in the above-described first exemplary embodiment. The cushioning materials 501 and 502 are assigned for the four corners each located in the four corners of the two opposing lateral sides in the printer 300. The cushioning material 501 is assigned for the corners 301, 304, 305 and 308 while the cushioning materials 502 is assigned for the corners 302, 303, 306 and 307. In this figure, the corners 307 and 308 are hidden and not shown.

Figure 10:
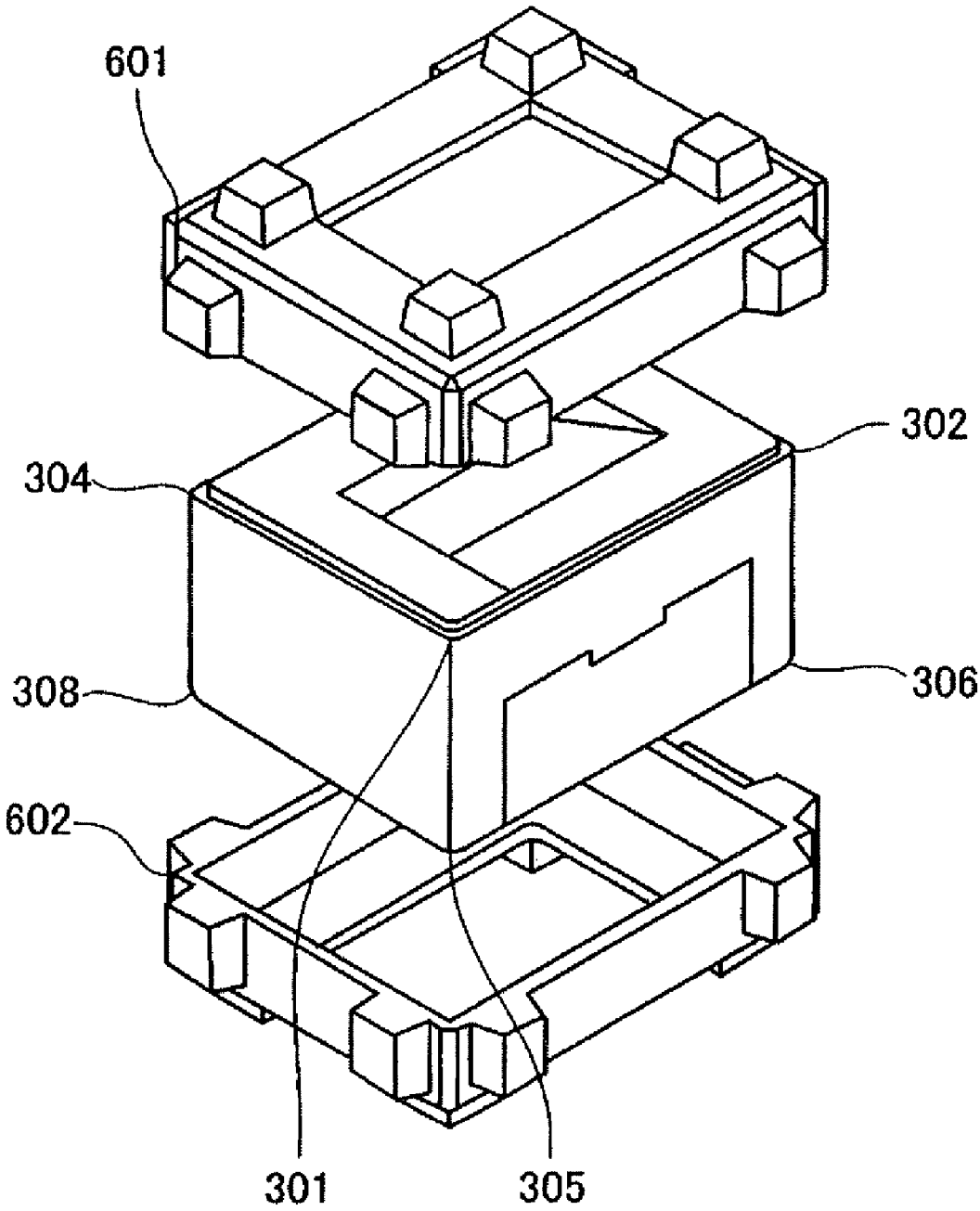
FIG. 10 is a perspective view showing a cushioning material according to a third exemplary embodiment of the present invention.

FIG. 10 is a perspective view showing cushioning materials according to a third exemplary embodiment of the present invention.

Like the second exemplary embodiment, a package material of the third exemplary embodiment is different in shape of the cushioning materials from but has the same auxiliary sheet 20 (see FIG. 2) as that of the first exemplary embodiment, which is therefore not shown in FIG. 10.

Cushioning materials 601 and 602 shown in FIG. 10 correspond to an integrated portion 601 corresponding to the four upper corners and an integrated portion 602 corresponding to the four lower corners, respectively, in the above-described first exemplary embodiment. The cushioning materials 601 and 602 are assigned for the four corners each located in the four corners of the opposing bottom and top sides in the printer 300. Here, the bottom and top sides of the printer 300 correspond to an example of the lateral sides of an article to be packaged, which are mentioned in the present invention. The cushioning material 601 is assigned for the corners 301, 302, 303 and 304 while the cushioning materials 602 is assigned for the corners 305, 306, 307 and 308. In this figure, the corners 303 and 307 are hidden and not shown.

As for the package material of the second exemplary embodiment having the cushioning materials 501 and 502 shown in FIG. 9 and the auxiliary sheet 20 (FIG. 2) and the package material of the third exemplary embodiment having the cushioning materials 601 and 602 shown in FIG. 10 and the auxiliary sheet 20 (FIG. 2), even if the cushioning materials are broken, the broken portions are not dislocated.

However, since the eight cushioning materials 11 to 18 assigned for the eight respective corners 301 to 308 of the printer 300 are separated from each other in the package material of the first exemplary embodiment shown in FIG. 2, the package material of the first exemplary embodiment requires a lesser amount of material for manufacture of the cushioning materials, as compared to the package material of the second exemplary embodiment shown in FIG. 9 and the package material of the third exemplary embodiment shown in FIG. 10.

Also, in the package material of the first exemplary embodiment shown in FIG. 2, the cushioning materials 11 to 14 assigned for the top side of the printer 300 are separated from the cushioning materials 15 to 18 assigned for the bottom side and are formed to be freely removed from the auxiliary sheet 20. Unlike the package material of the second exemplary embodiment, this allows a user to take out the printer 300 by detaching only the cushioning materials 11 to 14 assigned for the top side from the printer 300 without detaching the cushioning materials 15 to 18 assigned for the bottom side from the auxiliary sheet 20 after taking the printer 300 and the package material 100 out of the package box.

Figure 11:
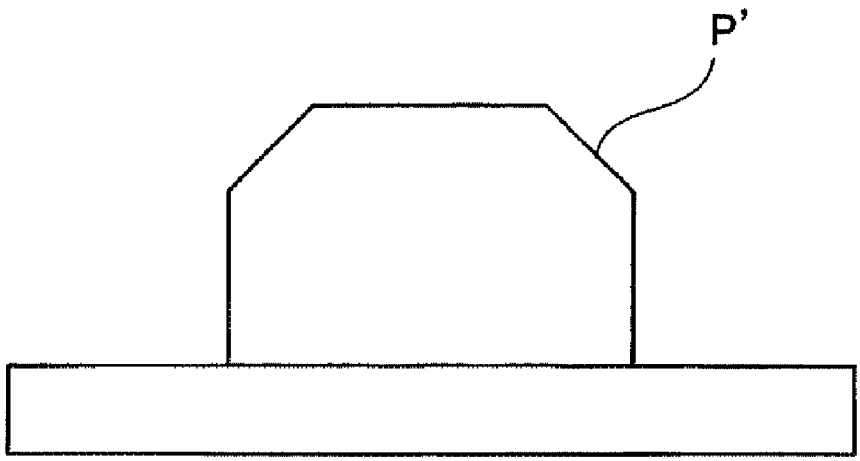
FIG. 11 is a view showing a modification of a projection.

In addition, although the projections mentioned in the present invention have been illustrated with the truncated pyramidal projections P in the above-described exemplary embodiments, the projections mentioned in the present invention is not limited thereto. For example, the projections P may have a head edge chamfered shape, as shown in FIG. 11.

In addition, although the article to be packaged which is mentioned in the present invention has been illustrated with the printer having the six sides and the eight corners in the above-described exemplary embodiments, the present invention is not limited thereto. For example, the article to be packaged, which becomes an object of the present invention, may have seven or more sides or five or less sides. In addition, the cushioning materials of the present invention may be modified to conform to the shape of article to be packaged.

Figure 12:
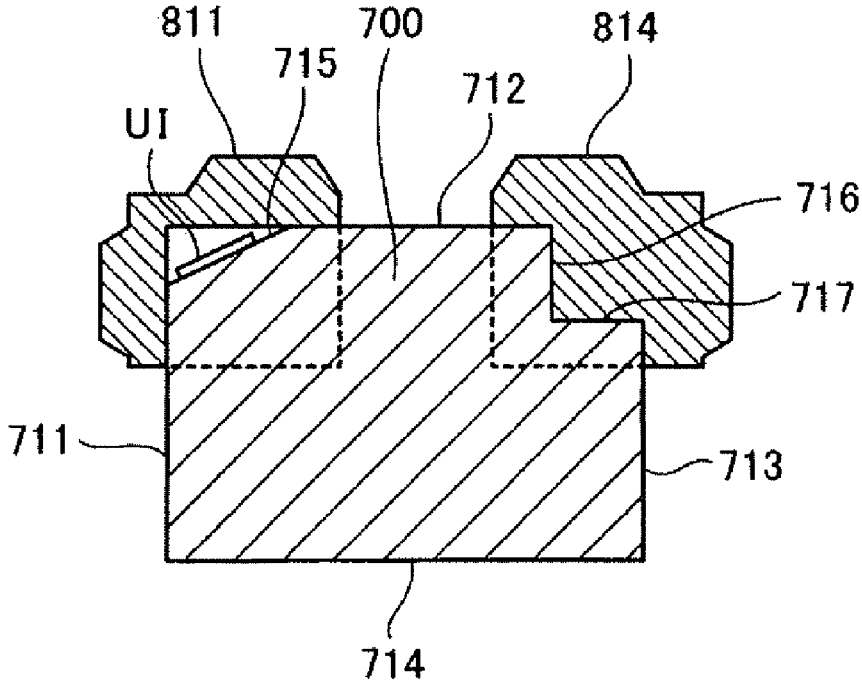
FIG. 12 is a sectional view showing a modification of the first exemplary embodiment.

FIG. 12 is a sectional view showing a modification of the above-described first exemplary embodiment. FIG. 12 shows a longitudinal section stretched from the front side of a printer 700 to its rear side. This figure shows only cushioning materials 811 and 814 mounted on the top side 712 of the printer 700 but does not show cushioning materials and an auxiliary sheet mounted on the bottom side 714.

While the printer 700 shown in FIG. 12 has four lateral sides including the front side 711 and the rear side 713, the top side 712 and the bottom side 714, an edge chamfered inclined plane 715 is formed between the top side 712 an the front side 711 and an operational panel UI for displaying various kinds of information of the printer 700 and receiving operations from a user is arranged on the inclined plane 715. In addition, the printer 700 has a shape in which its upper portion at the rear side is cut-out, and also has two cut-out planes 716 and 717 between the top side 712 and the rear side 713. A housing of the printer 700 shown in FIG. 12 has a shape having nine sides including the inclined plane 715 and the cut-out planes 716 and 717 in addition to the top side 712, the bottom side 714 and the four lateral sides.

Of the cushioning materials 811 and 814 shown in FIG. 12, the cushioning material 811 in the front side 711 is assigned for three sides including the top side 712, the front side 711 and the left side (not shown) but is assigned for the top side 712 and the front side 711 stretched to both sides of the inclined plane 715, avoiding the inclined plane 715 provided with the operational panel UI. In addition, while the cushioning material 814 in the rear side 713 is assigned for three sides including the top side 712, the rear side 713 and the left side (not shown), the cushioning material 814 is additionally provided with projections corresponding to the shape of the cut-out planes 716 and 717 and is also assigned for the cut-out planes 716 and 717.

As for the package material of the modification having the cushioning materials 811 and 814 shown in FIG. 12, even if the cushioning materials 811 and 814 are broken, the broken portions are not dislocated from their original position.

In addition, although the article to be packaged which is mentioned in the present invention has been illustrated with the printer in the above-described exemplary embodiments, the present invention is not limited thereto. For example, the article to be packaged may include not only electrical equipments such as a copier, a scanner, a facsimile machine and the like but also mechanical apparatuses and parts, individually wrapped chemicals and foods, and the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A package material comprising:

a plurality of cushioning materials each of which are assigned for corresponding to three sides of an article to be packaged, the plurality of cushioning materials are stretched in different directions, wherein the article to be packaged has a top side, four lateral sides and a bottom side, each of the plurality of cushioning materials is interposed between the corresponding three sides of the article to be packaged and corresponding three inner walls of a package box when the cushioning material is accommodated in the package box together with the article to be packaged, and each of the plurality of cushioning materials has three projections each projecting outwardly toward the three inner walls of the package box and coming into contact with the three inner walls of the package box; and a covering member that supports the plurality of cushioning materials each assigned for the three different sides of the article to be packaged, wherein the covering member includes:

a body plate having:

a bottom plate portion that is stretched across the bottom side of the article to be packaged;

lateral side plate portions that are folded from the bottom plate portion and stretched across two opposing lateral sides of the article; and a plurality of fold pieces that are folded from the body plate, wherein the covering member further includes:

a plurality set of three openings in which the three projections of the respective cushioning materials are inserted in a state where the cushioning materials are supported; and a plurality of folded portions that are respectively interposed between the three openings, wherein each of the plurality of cushioning materials assigned to the bottom side of the article to be packaged are supported by the bottom plate portion, one of the lateral side plate portions, and one of the fold pieces folded toward the corresponding lateral side, through one set of the plurality set of three openings respectively formed in the bottom plate portion, said one of the lateral side plate portions and said one of the fold pieces folded toward the corresponding lateral side, and wherein each of the plurality of cushioning materials assigned to the top side of the article to be packaged are supported by one of the lateral side plate portions, one of the fold pieces folded toward the corresponding lateral side, and one of the fold pieces folded toward the top side, through one set of the plurality set of three openings respectively formed in said one of the lateral side plate portions, said one of the fold pieces folded toward the corresponding lateral side, and said one of the fold pieces folded toward the top side.

2. The package material according to claim 1, wherein, the cushioning materials assigned for the bottom side of the article to be packaged and the cushioning materials assigned for the top side of the article to be packaged are separately supported to be removable from the covering member.

3. The package material according to claim 1 wherein, each of the plurality of projections has a tapered shape.

4. The package material according to claim 1, wherein each of the openings provided in the covering member has a dimension smaller than that of a base of the corresponding projection inserted in the opening, and a cut linking with each of the openings is formed in an auxiliary sheet.

5. The package material according to claim 1, wherein the covering member has a pair of handles, the covering member is stretched from edges at sides of the two lateral side plate portions, the edges being apart from the bottom plate portion, and is folded toward the top side of the article to be packaged.

* * * * *